US009954333B2

(12) United States Patent
Gorlt

(10) Patent No.: US 9,954,333 B2
(45) Date of Patent: Apr. 24, 2018

(54) METHOD OF FORMING A COMMUTATOR

(71) Applicant: Johnson Electric S.A., Murten (CH)

(72) Inventor: Wilfried Gorlt, Filderstadt (DE)

(73) Assignee: Johnson Electric S.A., Murten (CH)

( * ) Notice: Subject to any disclaimer, the term of this patent is extended or adjusted under 35 U.S.C. 154(b) by 592 days.

(21) Appl. No.: 14/546,698

(22) Filed: Nov. 18, 2014

(65) Prior Publication Data

US 2015/0137658 A1 May 21, 2015

(30) Foreign Application Priority Data

Nov. 18, 2013 (CN) ..... 2013 1 0581111

(51) Int. Cl.

| | |
|---|---|
| ***H01R 43/06*** | (2006.01) |
| ***H01R 43/10*** | (2006.01) |
| ***H01R 39/04*** | (2006.01) |
| *H01R 39/32* | (2006.01) |

(52) U.S. Cl.

CPC ..... *H01R 39/04* (2013.01); *H01R 43/06* (2013.01); *H01R 39/32* (2013.01); *Y10T 29/49011* (2015.01)

(58) Field of Classification Search

CPC ..... H02K 13/006; Y10T 29/49011; Y10T 29/49012; Y10T 29/53148; H01R 43/06; H01R 39/04; H01R 39/14

USPC ..... 29/597, 596, 598

See application file for complete search history.

(56) References Cited

U.S. PATENT DOCUMENTS 5,278,386 A * 1/1994 Mansour ..... B23K 26/0643 219/121.68

6,160,337 A * 12/2000 Warner ..... H01R 39/045 29/597

FOREIGN PATENT DOCUMENTS

| | | | |
|---|---|---|---|
| DE | 102007044359 | A1 | 3/2009 |
| JP | S57-202859 | A | 12/1982 |
| JP | S61-139249 | A | 6/1986 |
| JP | S61-247254 | A | 11/1986 |

OTHER PUBLICATIONS

3-Dimensional Circuitry Laser Direct Structuring Technology (LPKF-LDS™) for Moulded Interconnect Devices, last retrieved on Jan. 7, 2011, URL: http://www.lpkf.com/_mediafiles/1797-lpkf-lds-process.pdf.

* cited by examiner

*Primary Examiner* — Thiem Phan

(74) *Attorney, Agent, or Firm* — Muncy, Geissler, Olds & Lowe, P.C.

(57) ABSTRACT

A commutator is formed by providing an electrically insulating commutator body. First and second areas are defined on the commutator body covering a brush contact surface in an alternating manner. At least the surfaces of the first areas are formed of laser direct structured material. The first areas are treated by a laser to form metal particle layers. Conductive layers are formed on the metal particle layers by a plating process to form commutator segments. Terminals are connected to the conductive layers for connecting the commutator to rotor windings.

9 Claims, 5 Drawing Sheets

METHOD OF FORMING A COMMUTATOR

CROSS REFERENCE TO RELATED APPLICATIONS

This non-provisional patent application claims priority under 35 U.S.C. § 119(a) from Patent Application No. 201310581111.1 filed in The People's Republic of China on 18 Nov. 2013, the entire contents of which are hereby incorporated by reference.

FIELD OF THE INVENTION

This invention relates to a commutator for a brushed electric motor and to a method of forming the commutator.

BACKGROUND OF THE INVENTION

A commutator for a brushed electric motor typically includes a commutator body made of electrically insulating material, a plurality of commutator segments circumferentially spaced on the commutator body for making slide contact with the brushes of the motor, and a plurality of conductive terminals integrally extending from corresponding commutator segments.

In a known method of forming the commutator, the commutator body and the commutator segments are formed separately and the commutator segments are assembled on the outer surface of the commutator body. In another known method, an axially extending metal ring, with conductive terminals extending from one end thereof and a plurality of anchors formed on an inner surface, is firstly provided. The commutator body is then molded to the inner side of the metal ring such that the commutator body is fixed to the inner surface of the metal ring with the anchors embedded in the commutator body. Finally, a plurality of axially extending through slots are formed in the metal ring at positions between adjacent conductive terminals such that commutator segments electrically insulated from each other by the through slots are formed.

Both the assembled method and the molded method can make satisfactory commutators, the fixing of the segments to the base require the commutator base to be of a certain minimum size which is restricting the miniaturization of very small commutator motors.

The present invention aims to provide a new commutator that can be made with a reduced size, which makes it possible to produce a smaller electric motor.

SUMMARY OF THE INVENTION

Accordingly, in one aspect thereof, the present invention provides a method of forming a commutator, comprising: providing an electrically insulating commutator body having first areas and second areas being alternately distributed in a circular manner, at least surfaces of the first areas being formed of laser direct structuring material; forming metal particle layers on the first areas by laser treating the laser direct structuring material; and forming conductive layers on the metal particle layers, the conductive layers on adjacent first areas being electrically insulated from each other.

Preferably, the conductive layers are formed by depositing metal material on the metal particle layers by an electroless plating process.

Optionally, only a single conductive layer is formed on the metal particle layer on each of the first areas.

Alternatively, second conductive layers are formed on the conductive layers on the metal particle layers.

Preferably, only the first areas of the commutator body have metal particle layers formed thereon.

Preferably, the entire commutator body is formed of laser direct structuring material.

Optionally, the method further comprises: forming metal particle layers by a laser treatment process on both the first areas and the second areas of the commutator body; forming the conductive layers on the metal particle layers; and removing the conductive layers on the second areas.

Preferably, the method further comprises; providing a plurality of conductive terminals; and assembling the conductive terminals to the commutator body and electrically connecting the conductive terminals with the conductive layers on the first areas.

Alternatively, the method further comprises: providing terminal bases extending from the commutator body and having at least a surface formed of laser direct structuring material; forming metal particle layers on the terminal bases integrally extending from the first areas of the commutator body by the laser treatment process; and forming conductive layers on the metal particle layers on the terminal bases.

According to a second aspect, the present invention provides a commutator, comprising: an electrically insulating commutator body having first areas and second areas that are alternately distributed in a circular manner; a plurality of conductive layers disposed on the first areas of the commutator body; and a plurality of conductive terminals electrically connected with corresponding conductive layers, wherein surfaces of the first and second areas of the commutator body are of laser direct structuring material.

Preferably, radially outer surfaces of the second areas extend beyond radially inner surfaces of the conductive layers.

Optionally, the conductive layers comprise first conductive layers and second conductive layers formed on the first conductive layers.

Preferably, the conductive terminals are assembled to the commutator body.

Preferably, the first areas of the commutator body have recesses and the conductive terminals are inserted into the recesses.

Alternatively, the first areas of the commutator body have outwardly extending terminal bases on which conductive layers are formed.

Optionally, the conductive layers are non-planar.

Preferably, the entire commutator base is of laser direct structuring material.

BRIEF DESCRIPTION OF THE DRAWINGS

Preferred embodiments of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
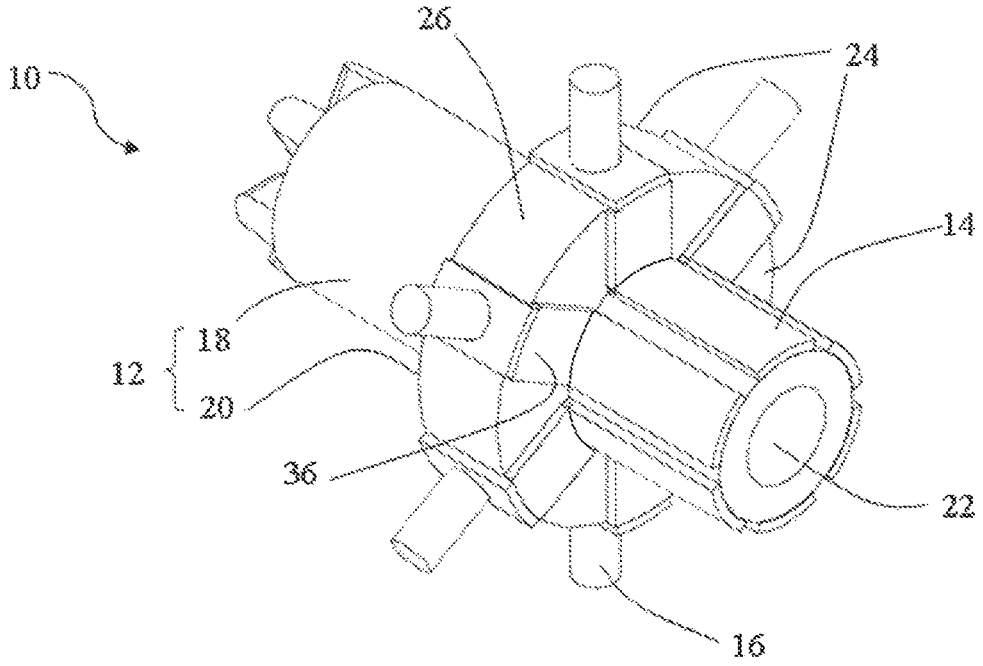
FIG. 1 illustrates a commutator in accordance with an embodiment of the present invention.
Figure 2:
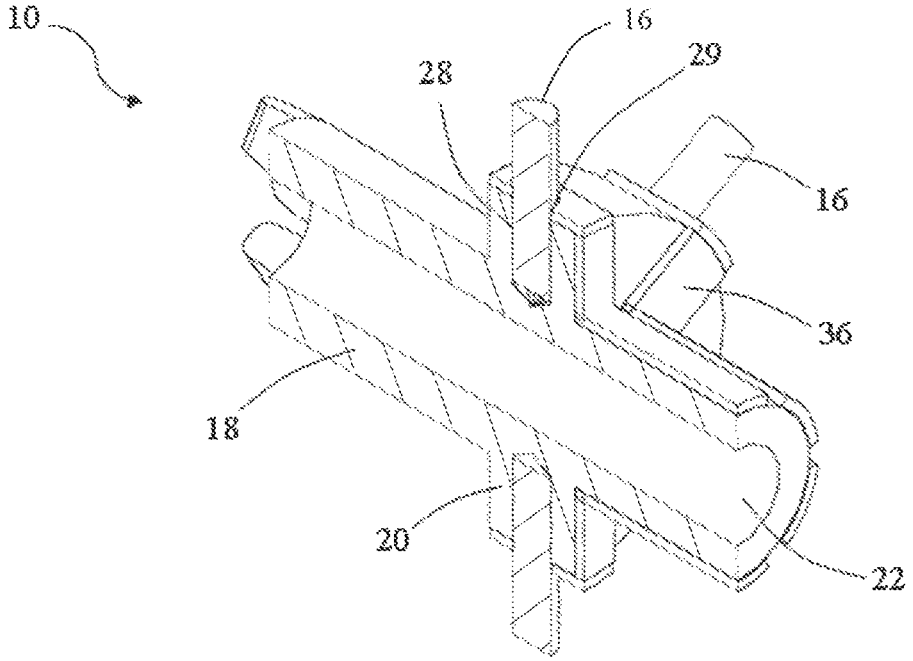
FIG. 2 is a sectional view of the commutator of FIG. 1.
Figure 3:
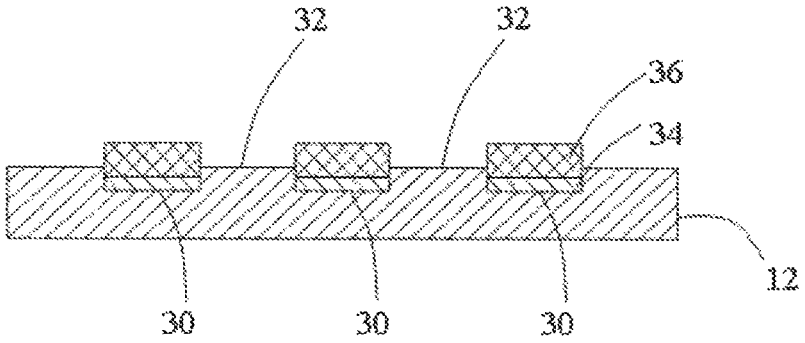
FIG. 3 is a diagrammatic illustration of a layer structure of a part of the commutator of FIG. 1.

Referring to FIGS. 1 to 3, a commutator 10 for an electric motor, in accordance with an embodiment of the present invention, includes a commutator body 12, a plurality of commutator segments 14 circumferentially spaced about the commutator body 12, and a plurality of conductive terminals 16 electrically connected to corresponding commutator segments 14. The commutator body 12 is made of electrically insulating material and includes a cylindrical portion 18 extending in the axial direction of the motor and an annular flange 20 extending radially and outwardly from the cylindrical portion 18. Preferably, the commutator body is made from a laser direct structuring (LDS) material. This type of material is also known as laser activatable plastics. This material is a doped electrically insulating plastics material having the characteristic that when ablated by a laser the doped material is activated to form metallic seeds which can be used as a catalyst for an electroless plating process. The metallic seeds form a metal particle layer, (also referred to as a reducing agent layer). The laser processing also forms a micro-rough surface to which the plated material is firmly anchored. An example of a suitable LDS material is a liquid crystal polymer (LCP) sold by RTP Company under the trade name RTP 3499-3 X 113393A. The plated material is preferably copper.

As an alternative, the entire commutator body need not be made of LDS material. The body may be made as a composite of standard insulating material and the LDS material, with the LDS material being provided in the areas where the conductive metal material is require, such as in the brush contact surface portion of the cylindrical portion 18 and the area connecting the brush contact surface portion to the area where the terminals are located.

The cylindrical portion 18 has an axial through hole 22 for receiving a shaft of the motor. The annular flange 20 has two axial end surfaces 24 and an outer circumferential surface 26 between the two axial end surfaces 24. A plurality of recesses 28 are formed in the outer circumferential surface 26 at regular intervals. A set of first areas 30 and a set of second areas 32 are alternately defined on one end of the outer surface of the cylindrical portion 18 that forms a brush contact surface portion and the annular flange 20 in the circumferential direction. The first areas 30 and the second areas 32 are preferably in the shape of strips. The recesses 28 are respectively located at corresponding first areas 30 on the annular flange 20. Recesses for the terminals may be formed directly in the cylindrical portion 18, allowing the flange to be omitted.

The metal particle layer 34 is formed on the first areas 30 by the laser treatment process and a conductive layer 36 is formed on the metal particle layer 34 by means of the plating process. The conductive layer 36 on each of the first areas 30 forms a continuous strip extending on the annular flange 20 and the cylindrical portion 18. The conductive layers 36 on the first areas 30 of the cylindrical portion 18 form commutator segments 14 on the brush contact surface, for making sliding contact with brushes of the motor. The conductive terminals 16 are inserted into the recesses 28 and electrically connected with the conductive layer 36 on the annular flange 20 and thereby being electrically connected with the commutator segments 14. The terminals provide a means for connecting the commutator to rotor windings of the motor.

Preferably, the plating process is an electroless plating process depositing a single layer of metal, preferably copper, on the metal particle layer. Optionally, a LPKF-LDS process developed by LPKF AG may be used as the laser treatment process in the present invention.

Figure 4:
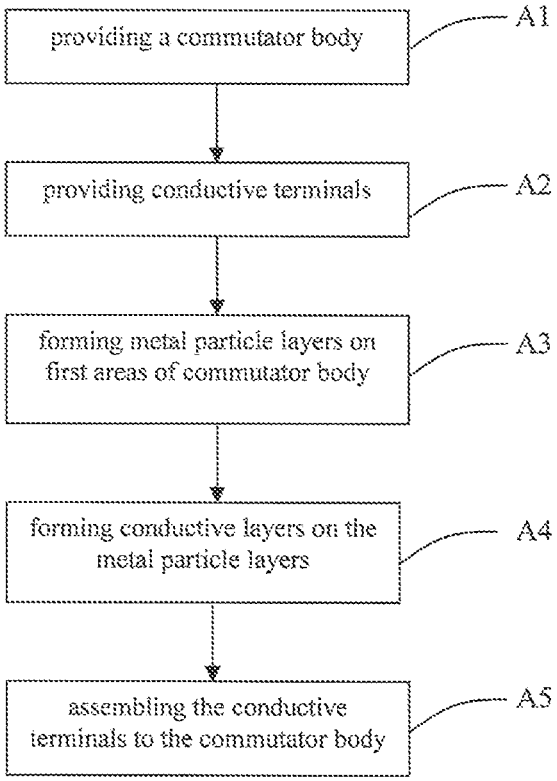
FIG. 4 is a flow chart for a method of forming the commutator of FIG. 1.

The flow chart of FIG. 4 illustrates a method of forming the commutator 10. The method comprises the following steps:

A1) providing a commutator body 12 having a brush contact surface portion. At least the brush contact surface portion and the flange (if present) of the commutator body 12 are formed of LDS material. The commutator body 12 may be entirely formed by the LDS material. Alternatively, the commutator body 12 may be formed by firstly forming a commutator base made of common electrically insulating material and then applying a layer of LDS material on the outer surface of the commutator base.

A2) providing a plurality of conductive terminals 16.

A3) forming a metal particle layer 34 on the commutator body 12 by laser treating a set of circumferentially spaced first strip areas 30 of the commutator body 12. A set of second strip areas 32 of the commutator body 12 between the first strip areas 30 remain non-metallic as they are not laser-treated. The metal particle layer 34 is depressed relative to the second strip areas 34 of the commutator body 12 as the laser treatment ablates the surface of the LDS material.

A4) forming a metal conductive layer 36 on the metal particle layer 34, thereby forming the commutator segments 16. In this embodiment, the metal conductive layer 36 is formed by an electroless plating process. The metallic elements in the metal particle layer 34 function as a reducing agent or catalyst to deposit metal material on the commutator body from the plating solution. As adjacent metal particle layers 34 are electrically insulated from each other, the adjacent metal conductive layers 36 on the metal particle layers 34 are also electrically insulated from each other. It should be understood that in this step openings 29 may be formed in the metal conductive layer 36 at the positions corresponding to the recesses 28 in the annular flange 20.

A5) assembling the conductive terminals 16 to the commutator body 12 by pressing the conductive terminals 16 through the openings 29 and into the recesses 28 of the annular flange 20 and electrically connecting the conductive terminals 16 with the metal conductive layers 36.

It should be understood that step A2, providing the conductive terminals, may be performed at any time before step A5.

Figure 5:
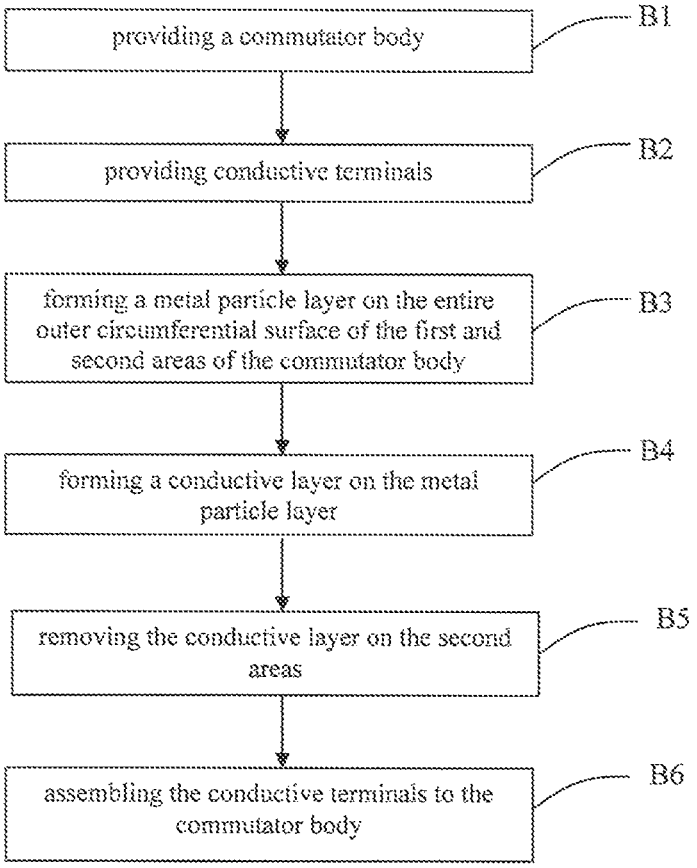
FIG. 5 is a flow chart of another method of forming the commutator of FIG. 1.

The flow chart of FIG. 5 illustrates another method of forming the commutator 10. The steps of this method include:

B1) providing a commutator body 1 having an axial through hole 22. The entire outer surface of the commutator body 12 that forms the brush contact surface is LDS material and has first and second strip areas defined thereon. Optionally, as mentioned previously, the entire commutator body may be of LDS material.

B2) providing a plurality of conductive terminals 16.

B3) forming a metal particle layer 34 on the entire brush contacting surface of the commutator body 12 by a laser treatment process.

B4) forming a metal conductive layer 36 on the metal particle layer 34.

B5) removing the metal conductive layer on the second strip areas 32 of the commutator body 12 so as to electrically insulate the metal conductive layers 36 on the first strip areas 30 of the commutator body 12 to form commutator segments. The metal conductive layer on the second areas may be removed by laser treatment, etching or high pressure water flow.

B6) assembling the conductive terminals 16 to the commutator body 12 and electrically connecting the conductive terminals 16 with corresponding metal conductive layers 36.

Figure 6:
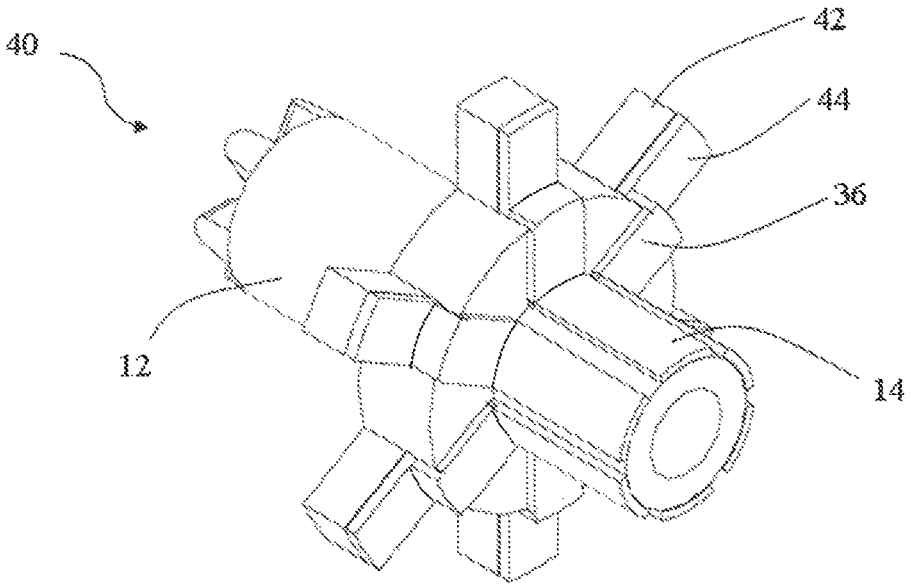
FIG. 6 illustrates a commutator in accordance with another embodiment of the present invention.
Figure 7:
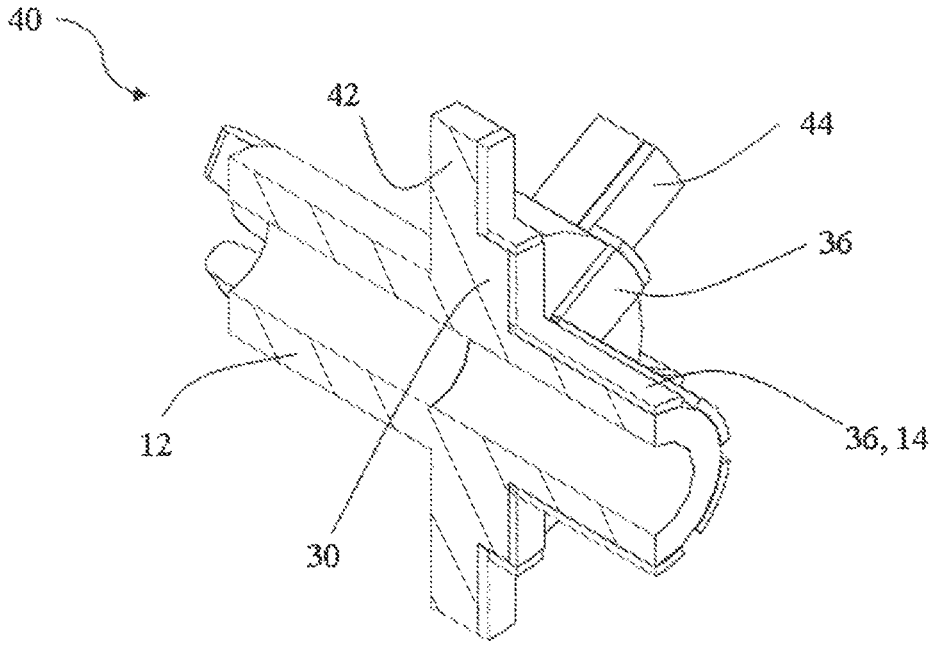
FIG. 7 is a sectional view of the commutator of FIG. 6.

FIGS. 6 and 7 illustrate a commutator 40 in accordance with another embodiment of the present invention. The differences between the commutator 40 and the commutator 10 is that there are no recesses 28 for the conductive terminals formed in the commutator body 12 of the commutator 40. Instead, a plurality of terminal bases 42 integrally and outwardly extend from the annular flange 20 or the cylindrical portion should there be no flange, and the metal particle layers 34 and the conductive layers 44 are in turn formed on the terminal bases 42 to form the conductive terminals 16. The conductive layers 44 on the terminal bases 42 are electrically connected with the conductive layers 36 on the first strip area 30 of the commutator body 12. In this embodiment, it is unnecessary to form separate conductive terminals 16 and therefore the step of assembling the conductive terminals to the commutator body 12 is avoided and the production cost is reduced.

Figure 8:
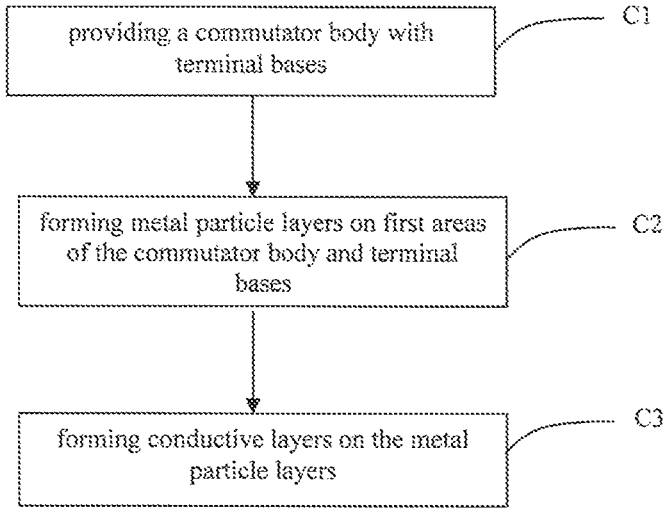
FIG. 8 is a flow chart of a method of forming the commutator of FIG. 6.

The flow chart of FIG. 8 illustrates a method of forming the commutator 40 of FIG. 6. The method includes the following steps:

C1) providing an electrically insulating commutator body 12 having a plurality of circumferentially spaced terminal bases 42 integrally extending from the first strip areas 30 of the commutator body 12. The surfaces of the terminal bases 42 and the outer surfaces of the first strip areas 30 of the commutator body 12 are of LDS material.

C2) forming a metal particle layer 34 on said outer surfaces of the terminal bases 42 and the first strip areas 30 of the commutator body 12 by a laser treatment process.

C3) forming a conductive layer on the metal particle layer 34. The metal conductive layer 36 on the first strip areas 30 form the commutator segments 14. The terminal bases 42 and the conductive layer 44 on the terminal bases 42 form conductive terminals 16 for electrically connecting the commutator segments with rotor windings of the motor. Preferably, the conductive layers 36 and 44 are formed by an electroless plating process.

Figure 9:
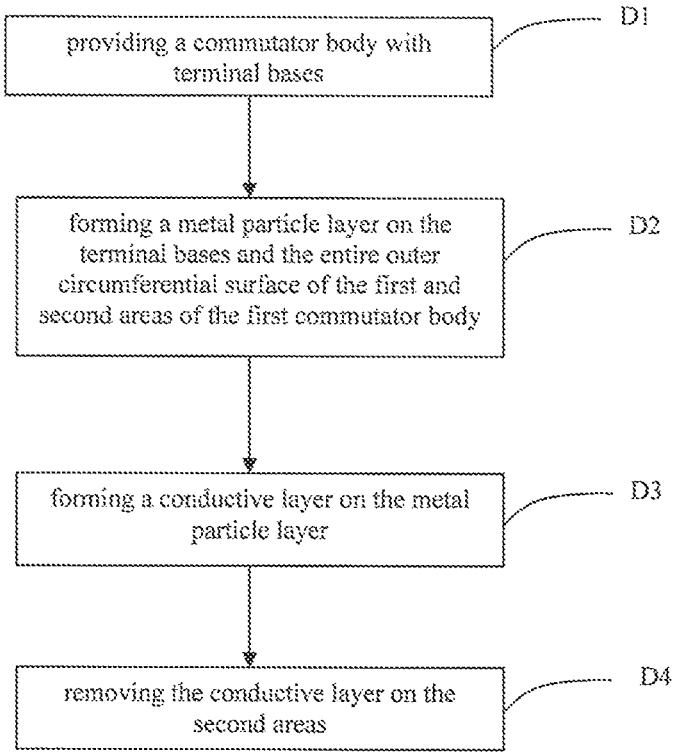
FIG. 9 is a flow chart of another method of forming the commutator of FIG. 6.

The flow chart of FIG. 9 illustrates another method of forming the commutator 40 of FIG. 6.

D1) providing an electrically insulating commutator body 12 having a brush contact surface portion, first areas 30 and second areas 32 extending over the brush contact surface portion and a plurality of circumferentially spaced terminal bases 42 integrally extending from the first areas 30 of the commutator body 12. The entire brush contact surface portion and the outer surfaces of the terminal bases 42 are of LDS material.

D2) forming a metal particle layer 34 on the surfaces of the first and second areas and the terminal bases 42 by a laser treatment process.

D3) forming a conductive layer 36 on the metal particle layer 34. The terminal bases 42 and the conductive layer 36 on the terminal bases 42 form conductive terminals 16 for electrically connecting the commutator to rotor winding of the motor.

D4) removing sections of the conductive layer 36 formed on the second areas 32 of the commutator body 12 so as to electrically insulate the sections of the conductive layer 36 on the first areas 30. The sections of the conductive layers 36 on the first areas 30 of the commutator body 12 form the commutator segments 14 electrically connected with corresponding conductive terminals 16.

Figure 10:
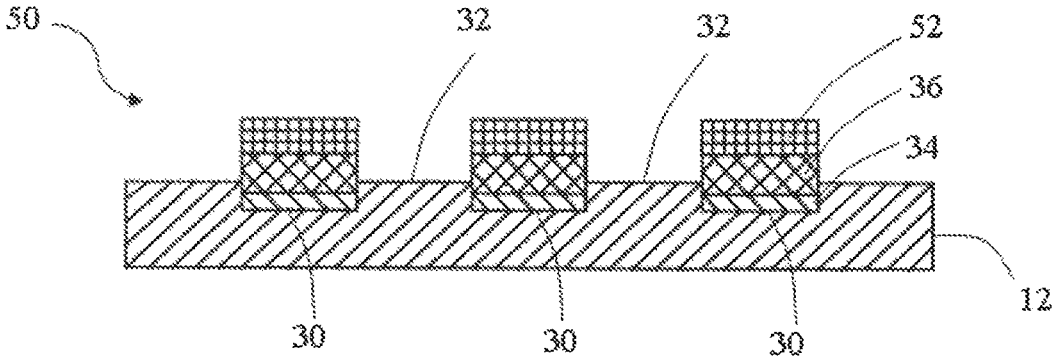
FIG. 10 is a diagrammatic illustration of a layer structure of a commutator in accordance with a further embodiment of the present invention.

FIG. 10 illustrates the layer structure of a commutator 50 in accordance with yet another embodiment of the present invention. The commutator 50 has a second conductive layer 52 formed on the first conductive layer 36. Preferably, the second conductive layer 52 may be formed on the first conductive layer 36 by an electroplating process and the first and second conductive layers 36 and 52 may contain different materials. In one example, the first conductive layer 36 is made of copper while the second conductive layer 52 is made of silver. The commutator 50 with the double conductive layer structure in this embodiment has a longer lifespan, compared with a commutator having a single conductive layer structure.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

For example, while the embodiments show a cylindrical type commutator, the invention is also applicable to planar type commutators.

The invention claimed is:

1. A method of forming a commutator, comprising:

providing an electrically insulating commutator body having first areas and second areas being alternately distributed in a circular manner, at least surfaces of the first areas being formed of laser direct structuring material;

forming metal particle layers on the first areas by laser treating the laser direct structuring material; and forming conductive layers on the metal particle layers, the conductive layers on adjacent first areas being electrically insulated from each other.

2. The method of claim 1, wherein the conductive layers are formed by depositing metal material on the metal particle layers by an electroless plating process.

3. The method of claim 1, wherein only a single conductive layer is formed on the metal particle layer on each of the first areas.

4. The method of claim 1, further comprising forming second conductive layers on said conductive layers on the metal particle layers.

5. The method of claim 1, wherein only the first areas of the commutator body have metal particle layers formed thereon.

6. The method of claim 1, wherein the entire commutator body is formed of laser direct structuring material.

7. The method of claim 1, comprising:

forming metal particle layers by a laser treatment process on both the first areas and the second areas of the commutator body;

forming the conductive layers on the metal particle layers; and removing the conductive layers on the second areas.

8. The method of claim 1, further comprising:

providing a plurality of conductive terminals; and assembling the conductive terminals to the commutator body and electrically connecting the conductive terminals with the conductive layers on the first areas.

9. The method of claim 1, further comprising:

providing terminal bases extending from the commutator body and having at least a surface formed of laser direct structuring material;

forming metal particle layers on the terminal bases integrally extending from the first areas of the commutator body by the laser treatment process; and forming conductive layers on the metal particle layers on the terminal bases.

* * * * *